US007654854B1

(12) United States Patent
Yang

(10) Patent No.: US 7,654,854 B1
(45) Date of Patent: Feb. 2, 2010

(54) PUSH-CORD ENERGY SAVING LAMPHOLDER EASY FOR THE STRIPPING OF CORD

(75) Inventor: Wen-Ho Yang, Taipei County (TW)

(73) Assignee: Sun-Lite Sockets Industry Inc., Taoyuan (TW)

( * ) Notice: Subject to any disclaimer, the term of this patent is extended or adjusted under 35 U.S.C. 154(b) by 16 days.

(21) Appl. No.: 12/230,339

(22) Filed: Aug. 28, 2008

(51) Int. Cl.
*H01R 4/26* (2006.01)

(52) U.S. Cl. ..... 439/419; 439/602

(58) Field of Classification Search ..... 439/414, 439/419, 602, 619, 699.2, 314
See application file for complete search history.

(56) References Cited

U.S. PATENT DOCUMENTS

| | | | | |
|---|---|---|---|---|
| 4,199,212 | A * | 4/1980 | Baldyga | 439/587 |
| 4,804,343 | A * | 2/1989 | Reedy | 439/854 |
| 5,762,519 | A * | 6/1998 | Hwang | 439/419 |
| 5,814,927 | A * | 9/1998 | Chen | 313/318.03 |
| 7,048,402 | B2 * | 5/2006 | Roeth et al. | 362/89 |

* cited by examiner

*Primary Examiner*—Khiem Nguyen
(74) *Attorney, Agent, or Firm*—Bacon & Thomas, PLLC

(57) ABSTRACT

The present invention is to provide a push-cord energy saving lamp holder that is easy for the stripping of power cord, which comprises: a lamp holder body, having push-cord holes and nearby cord-stripped sockets at its top, and first lodging troughs and second lodging troughs in its internal; a set of push-cord stands, each having a plug face from which a power connect face and a conducting face are formed by bending its top and bottom portions, where the edge of the power connect face is further divided into a power connect notch corresponding to the push-cord hole and a cord-stripped trench corresponding to the cord-stripped socket; a set of conducting springy slices, having a plug face lodged in the second lodging trough for a fixing and a conducting face connected to the conducting face of the push-cord stand; and a cover plate, placed on the hollow of the lamp holder body, having a set of positioning grooves on the plate, which accommodate the insertion of the conducting terminals of an energy saving lamp; the cord-stripped socket is designed for accommodating the insertion of a slender cord-stripped tool, where the tool is pushed to bend the cord-stripped trench, which in turn bends the power connect notch, and the effect causes the conducting end portion of the power cord is released easily from the push-cord hole.

1 Claim, 8 Drawing Sheets

PUSH-CORD ENERGY SAVING LAMPHOLDER EASY FOR THE STRIPPING OF CORD

BACKGROUND OF THE INVENTION

1. Field of the Invention

The present invention relates to push-cord energy saving lamp holders that are easy for the stripping of cord, more particularly, to one that has a cord-stripped socket next to the push-cord hole of the lamp holder body, where a slender stripping tool can be inserted to easily actuate the stripping of the power cord.

2. Description of the Prior Art

Energy saving lamps gradually become the main stream of illumination because of their saving energy, which considerably facilitates the popularity of the energy saving lamp holders among lighting appliances. Whatever the structure it could be, the energy saving lamp holder has to connect to the power supply for the illumination of the lamp. In general, the joining between the energy saving lamp holder and the power cord is categorized into two ways, threaded type and push-cord type, where the threaded type is more complicated in the manipulation that results in unpopularity; the joining operation of the push-cord type is done by inserting the conducting end portion of the power cord directly into the push-cord hole of the lamp holder for the purpose of a clamping. Due to the easy handling of the joining, the push-cord type for sure gains popularity. However, it is hard to strip the power cord once the joining is firm. A strip of the cord by force will generally bring in electric shock or destroy of the joining with the lamp holder, which is actually the worst drawback.

SUMMARY OF THE INVENTION

In face of the foregoing drawback, the inventor conceived the plot for a push-cord energy saving lamp holder easy for the stripping of cord, to overcome the drawback of hard to strip the cord of the prior art.

The objective of the present invention is to provide a push-cord energy saving lamp holder that operates the stripping of the power cord easily to be convenient for maintenance.

To accomplish the aforesaid objective, the push-cord energy saving lamp holder easy for stripping of cord of the present invention, comprises: a lamp holder body, having a set of symmetrically positioned push-cord holes and nearby a set of cord-stripped sockets at its top, a hollow at its bottom, where the push-cord holes and the cord-stripped sockets all extend to the internal of the lamp holder body, and the lamp holder body is provided with a set of symmetrically positioned first lodging troughs and second lodging troughs at its internal, which are formed by the gaps among the uneven erect pillars; a set of push-cord stands, each having a plug face from which a power connect face and a conducting face are formed by bending its top and bottom portions, where the edge of the power connect face is divided into a power connect notch at the inner side and a cord-stripped trench at the outer side, while the conducting face is a flat piece. During the assembly, the plug face is lodged in the first lodging trough for a fixing, where the power connect notch of the power connect face is positioned right inside the push-cord hole, and the cord-stripped trench is positioned right inside the cord-stripped socket. The conducting end portion, made from the peeling of the skin of the end portion of a power cord, is inserted in the push-cord hole to touch the power connect notch. By pressing the power connect notch, the conducting end portion will be clamped in the gap between the power connect notch and the lamp holder body, and the electric power is thus conducted to the push-cord stand; a set of conducting springy slices, having a plug face and a conducting face, where the plug face is lodged in the second lodging trough for a fixing during the assembly, and the back end of the conducting face will connect to the conducting face of the push-cord stand for the conduction of power; and a cover plate, having a set of symmetrically located positioning grooves on the plate which comprises a major opening and a connected thin arced groove. During the assembly, the cover plate is placed on the hollow of the lamp holder body, which makes the conducting springy slice to correspond to the positioning groove and reside next to the positioning groove, where the major openings of the positioning grooves accommodate the insertion of the two conducting terminals of an energy saving lamp, followed by a twist of the terminals along the thin arced grooves and a contact with the conducting springy slice for a fixing, and eventually the conduction of power illuminates the energy saving lamp; the cord-stripped socket is designed for accommodating the insertion of a slender cord-stripped tool, where the tool is pushed to bend the cord-stripped trench, which in turn bends the power connect notch, and the effect causes the conducting end portion of the power cord is released from the clamping, where the conducting end portion is thus easily stripped from the push-cord hole.

DETAILED DESCRIPTION OF THE INVENTION

To achieve the foregoing objects of the present invention, the techniques adopted and the achievable function are detailed described with reference to the following preferred exemplified embodiment and the accompanying drawings, which is expected to help the honorable Examiner in comprehending the contents of the present invention thoroughly.

Figure 1:
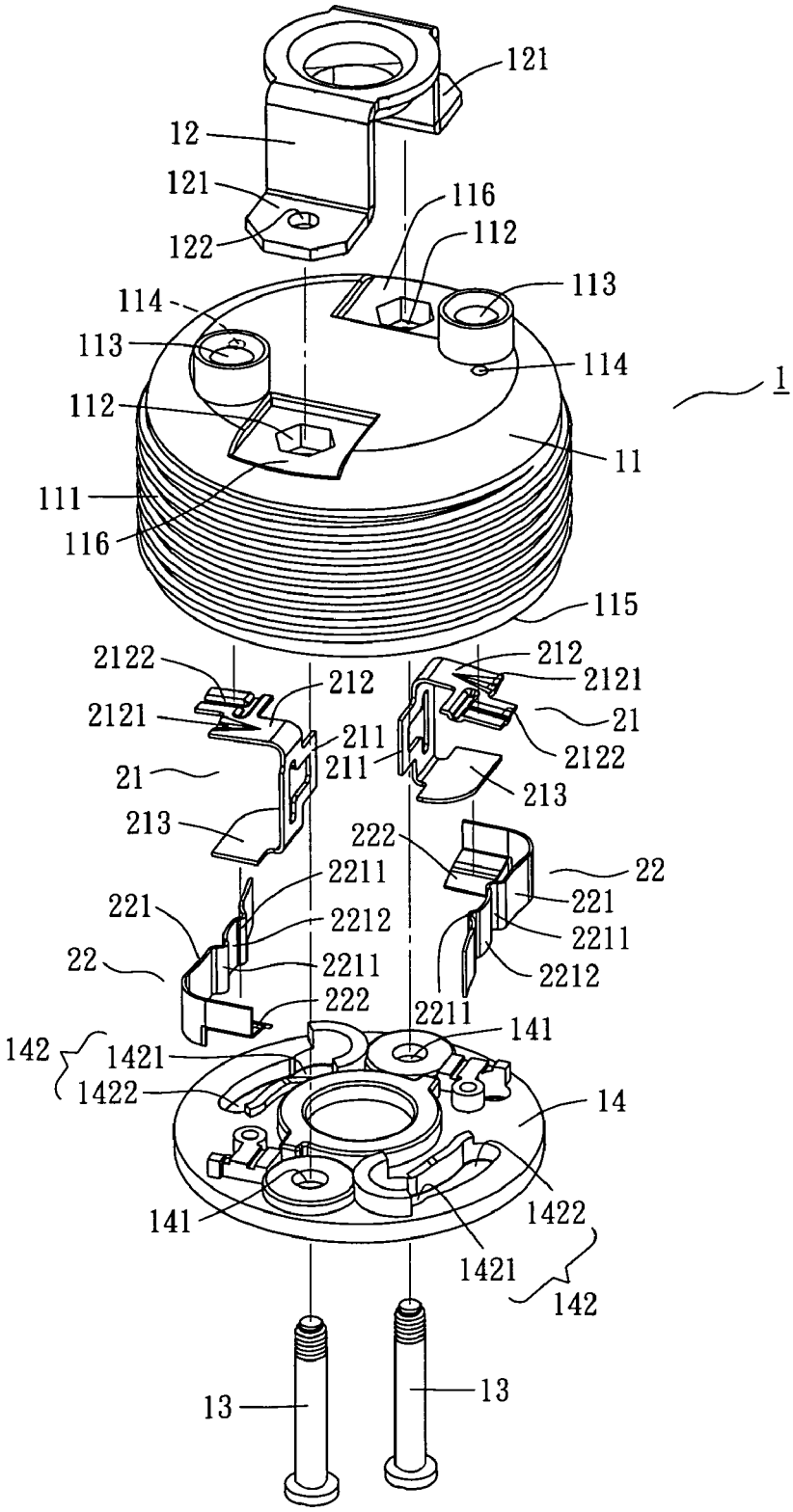
FIG. 1 is a three-dimensional exploded view of the exemplified embodiment of the present invention.
Figure 2:
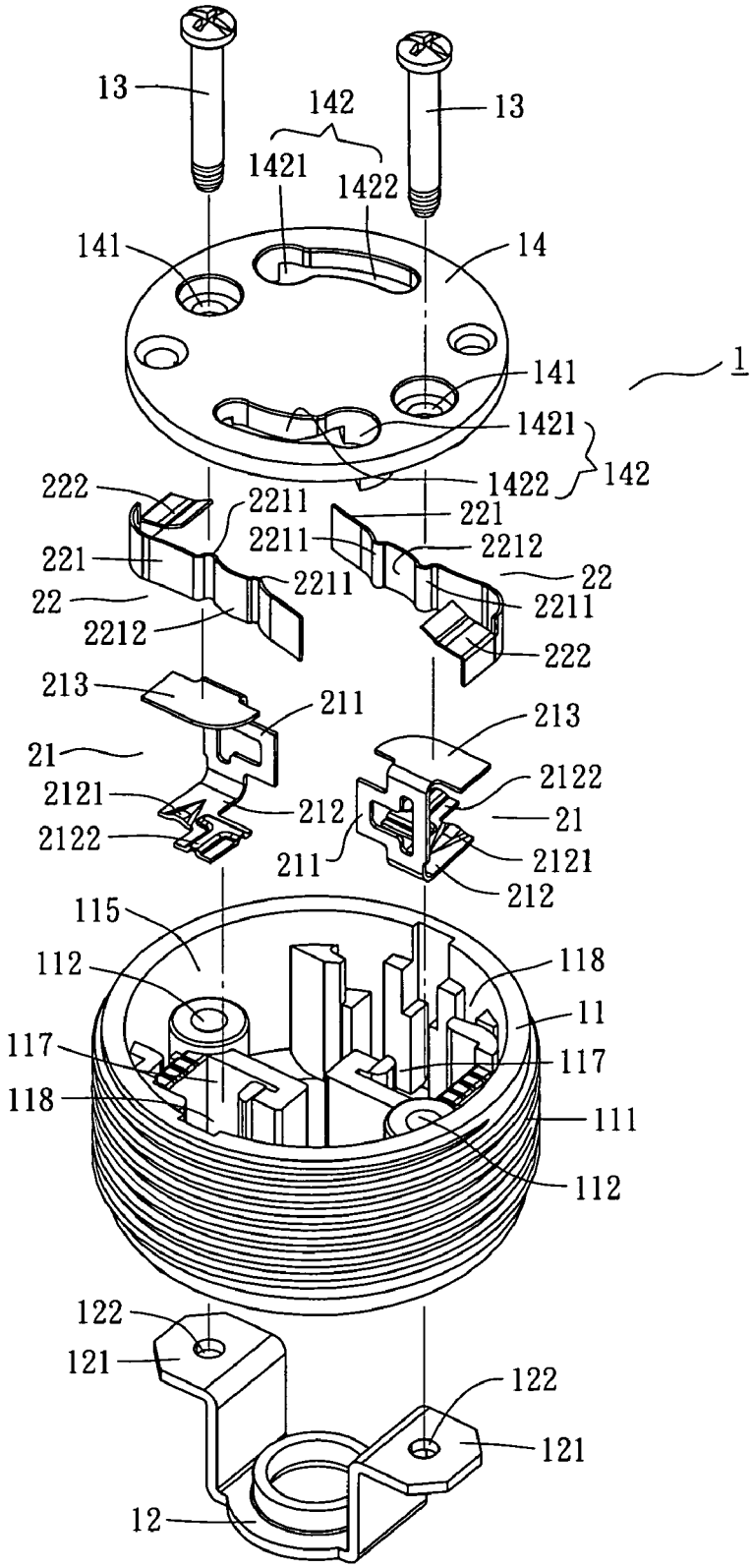
FIG. 2 is another three-dimensional exploded view of the exemplified embodiment of the present invention.
Figure 3:
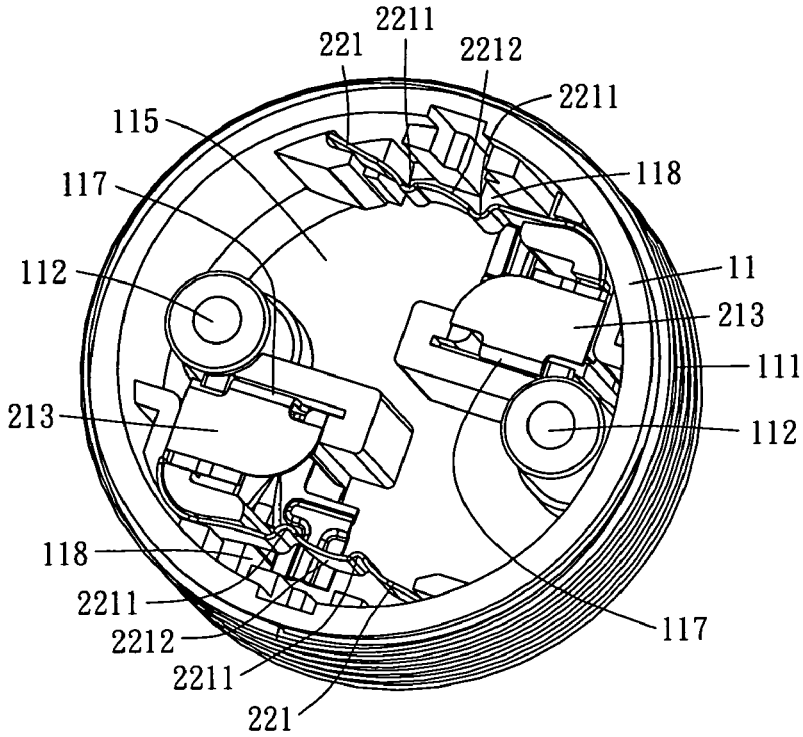
FIG. 3 is a three-dimensional assembled view of the partial components of the exemplified embodiment of the present invention.
Figure 4:
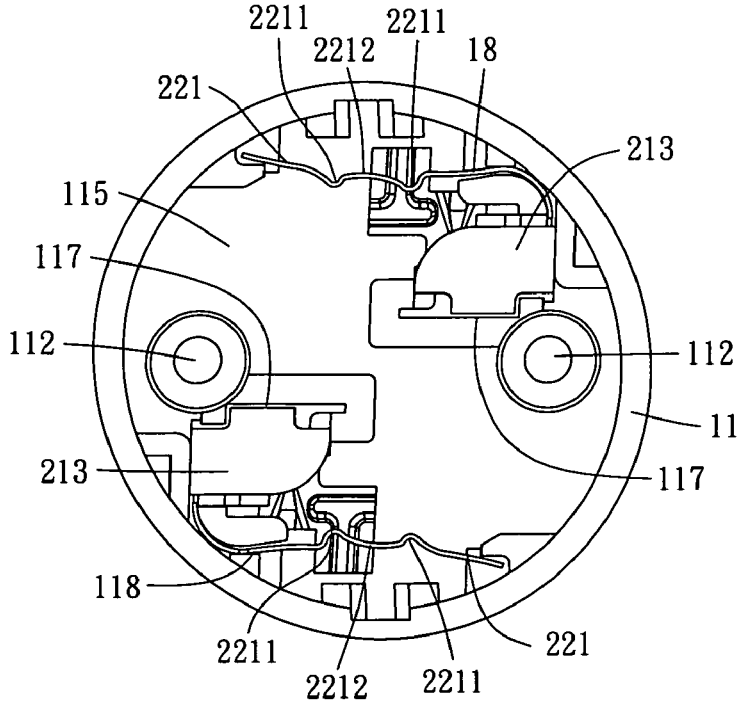
FIG. 4 is an assembled bottom view of the partial components of the exemplified embodiment of the present invention.
Figure 5:
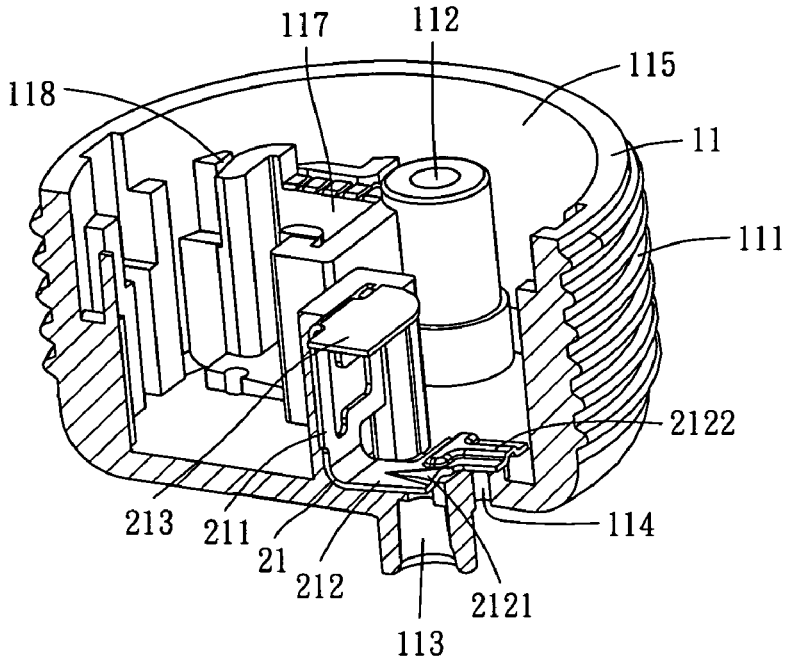
FIG. 5 is a three-dimensional sectional view of the assembly of the push-cord stand of the exemplified embodiment of the present invention.

Referring to FIGS. 1 & 2, the exemplified embodiment of the present invention is an energy saving lamp holder 1, which is a push-cord energy saving lamp holder that is easy for stripping the power cord, comprising a lamp holder body 11, preferred in cylinder shape, and having outer threads 111 around its surface, for the helical joining with other objects (for instance: lampshade or protective shell), where its top is provided with a set of symmetrically positioned threaded holes 112, a set of push-cord holes 113 and a set of cord-stripped sockets 114, its bottom is provided with a hollow 115, where the threaded holes 112 are extended to the internal of the lamp holder body 111, and its top is further provided with indented positioning grooves 116 near its edge, where the set of push-cord holes 113 and the set of cord-stripped sockets 114 are next to it; a sustaining frame 12, which is Π-shaped, where its two sides have two outward bottom pieces 121 for fixing in the positioning grooves 116. A joining article 13 penetrates the through hole 141 of a cover plate 14 from the bottom, through the threaded hole 112 of the lamp holder body 11, and upwardly to the joining hole 122 of the bottom piece 121 for a fixing, which is for fastening the sustaining frame 12 to the top of the lamp holder body 11, and for fastening the cover plate 14 to the hollow 115 of the lamp holder body 11; the lamp holder body 11 is provided with not only the threaded holes 112 at its internal, but a set of symmetrically positioned first lodging troughs 117 and a set of symmetrically positioned second lodging troughs 118, which are formed by the gaps among the uneven erect pillars;

The first lodging troughs 117 accommodate a set of push-cord stands 21, while the second lodging troughs 118 accommodate a set of conducting springy slices 22. Referring to FIGS. 3-5, the push-cord stand 21 comprises a plug face 211 and a power connect face 212 and a conducting face 213 which are formed by bending the top and bottom portions of the plug face, where the edge of the power connect face 212 is divided into a power connect notch 2121 at inner side and an outer cord-stripped trench 2122 at outer side, while the conducting face 213 is a flat piece; during the assembly, the plug face 211 is lodged in the first lodging trough 117 for a fixing, where the power connect notch 2121 of the power connect face 212 is placed right inside the push-cord hole 113, and the cord-stripped trench 2122 is placed right inside the cord-stripped socket 114.

Figure 6:
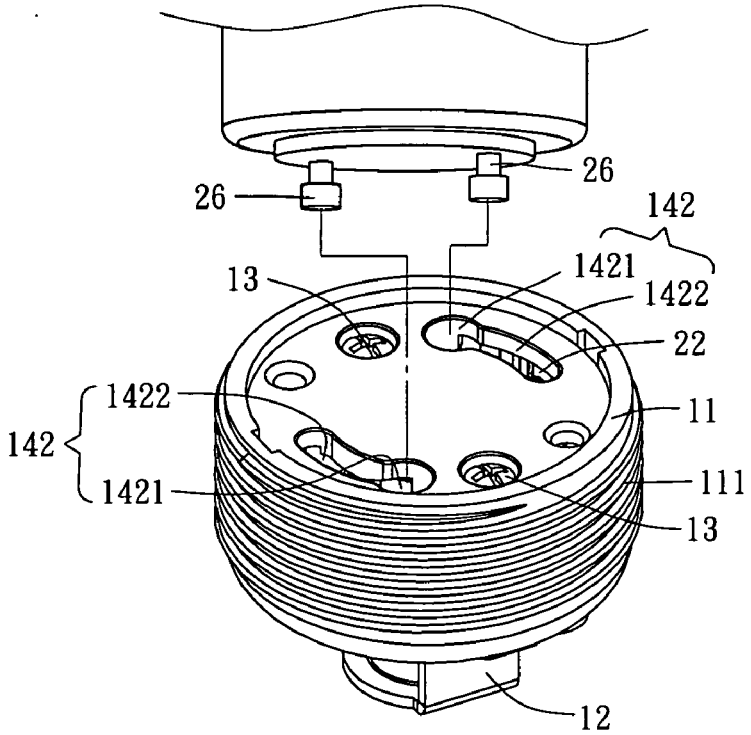
FIG. 6 is a three-dimensional exploded view of the use of the exemplified embodiment of the present invention.

The conducting springy slices 22 are a flat piece with a couples of bends, comprising a plug face 221 and a conducting face 222 made by a bend with an incline at its back end, the plug face 221 each is further provided with a catch area 2212 which is formed by two shaped protrusions 2211. During the assembly, the plug face 221 is lodged in the second lodging trough 118 for a fixing, and the back end of the conducting face 222 will connect to the conducting face 213 of the push-cord stand 21 (shown in FIGS. 3 & 4);

Referring to FIGS. 1, 2 & 6, the cover plate 14 is a circular plate that can cover the hollow 115 of the lamp holder body 11. The plate is provided with a set of symmetrically positioned through holes 141, and further contains a set of symmetrically positioned positioning grooves 142, where the positioning groove 142 is further made up of a major opening 1421 and a connected thin arced groove 1422. During the assembly, the cover plate 14 is placed on the hollow 115 of the lamp holder body 11, and the through hole 141 is placed to join the corresponding threaded hole 112, which makes the conducting springy slice 22 to correspond to the positioning groove 142 and to reside next to the positioning groove 142. Lastly, the joining article 13 is used to penetrate the through hole 141 and the threaded hole 112 and upwardly to connect to the joining hole 122 on the bottom piece 121, which fastens the cover plate 14 to the hollow 115 of the lamp holder body 11.

Figure 7:
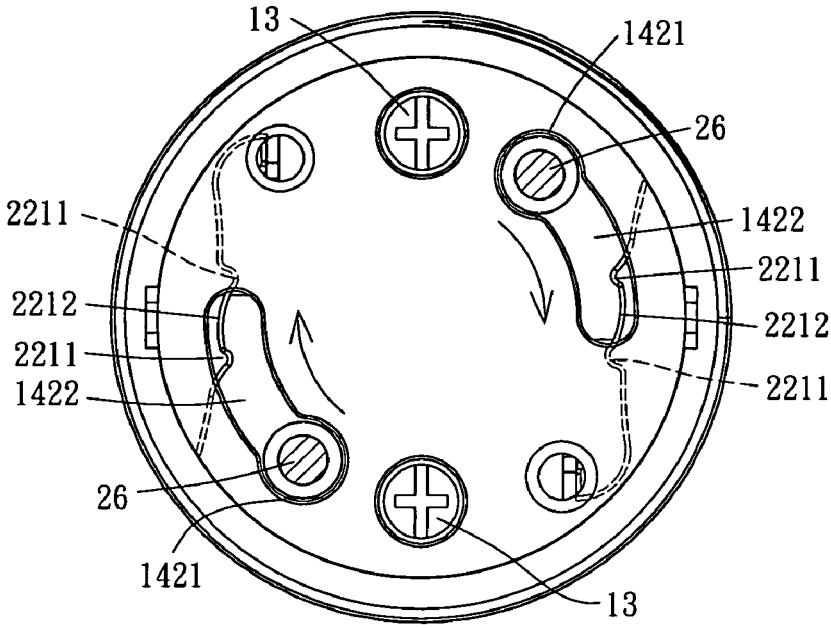
FIG. 7 is a motion view of the assembly for the use of the exemplified embodiment of the present invention.
Figure 8:
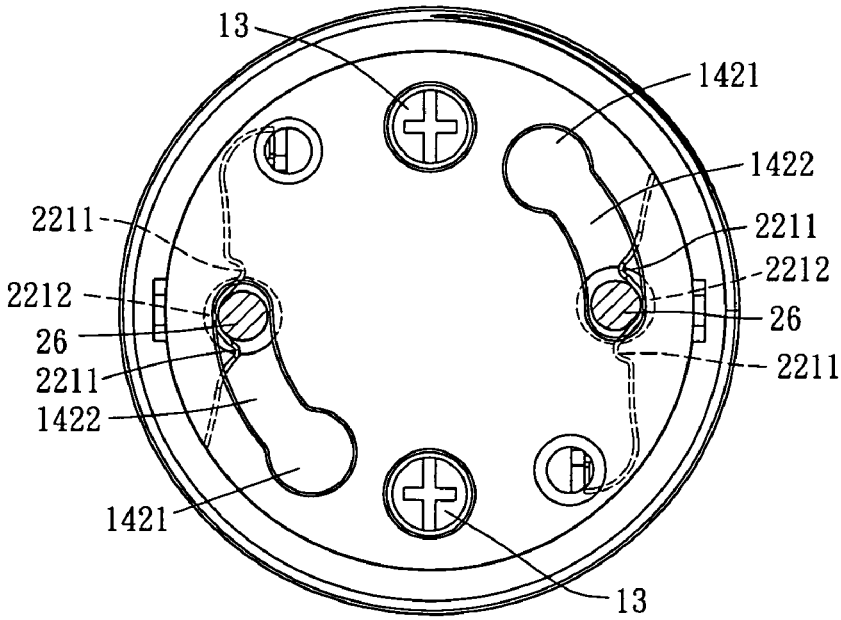
FIG. 8 is another motion view of the assembly for the use of the exemplified embodiment of the present invention.

During the use, the positioning grooves 142 on the cover plate 14 are for accommodating energy saving lamp. Referring to FIGS. 6-8, an assembler holds an energy saving lamp and aims the two conducting terminals 26 at the major openings 1421 of the positioning grooves 142 and followed by a insertion, and rotates the energy saving lamp to have its conducting terminals 26 moving along the thin arced groove 1422. It will touch a protrusion 2211. With an extra pressure, it will pass the protrusion 2211 to reach the catch area 2212 and stay therein.

Figure 9:
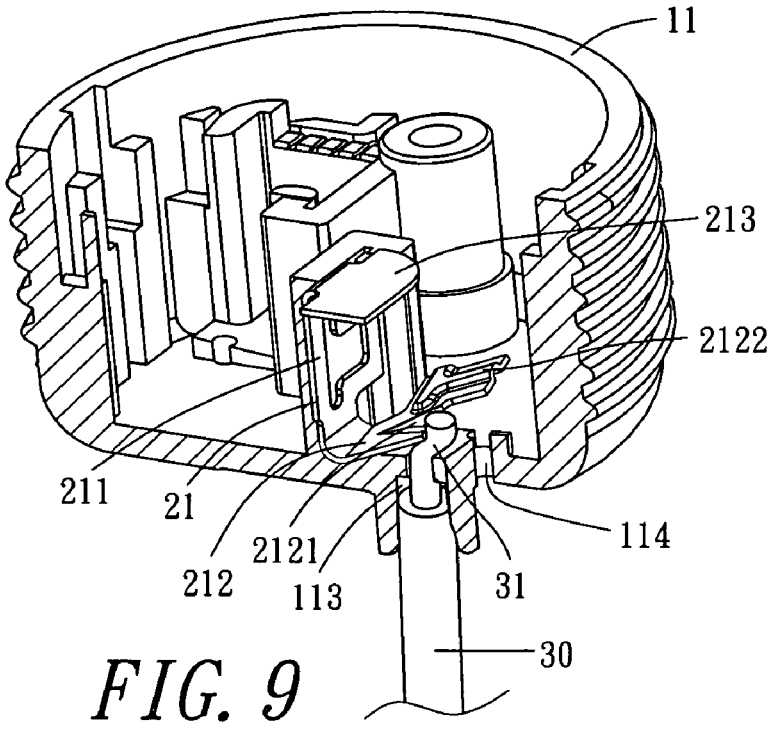
FIG. 9 is a three-dimensional sectional view of the insertion of the power cord of the exemplified embodiment of the present invention.
Figure 10:
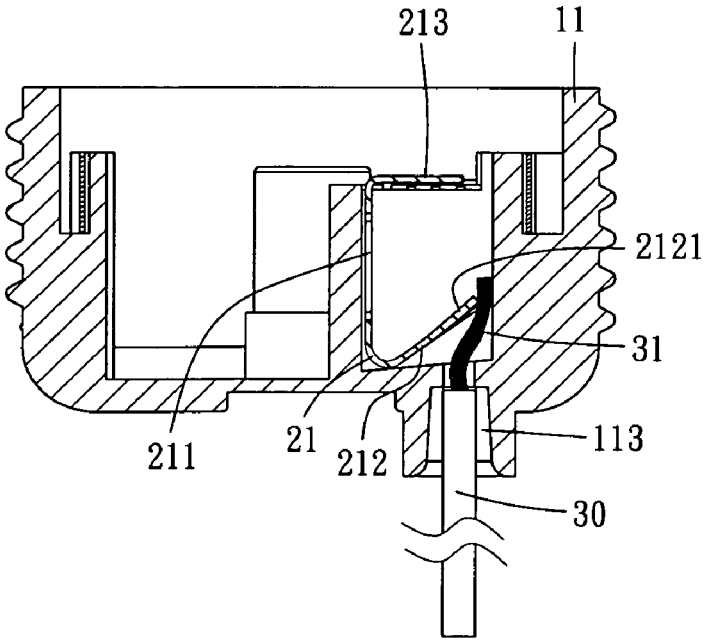
FIG. 10 is a sectional side view of the insertion of the power cord of the exemplified embodiment of the present invention.

The power cord 30 is inserted through the push-cord hole 113, shown in FIGS. 9 & 10, where the skinless conducting end portions 31 of two terminals of the power cord 30 are inserted into the push-cord hole 113 and touch the power connect notch 2121 of the power connect face 212. With a bit pressure on the power connect notch 2121 to have it bent, the conducting end portions 31 is then lodged in the gap between the power connect notch 2121 and the lamp holder body 11 for a stable clamping; the electric power is thus conducted to the push-cord stand 21. Since the back end of the conducting face 222 of the conducting springy slice 22 connects to the conducting face 213 of the push-cord stand 21, the electric power passes from the conducting springy slice 22, through the two conducting terminals 26, and to illuminate the energy saving lamp.

Figure 11:
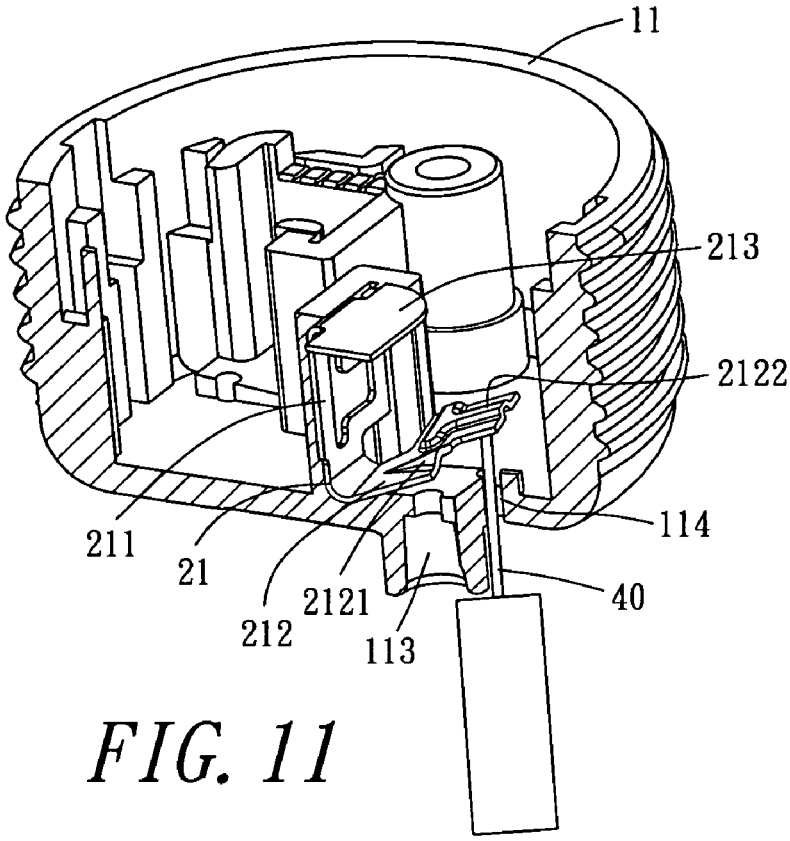
FIG. 11 is a three-dimensional sectional view of the stripping for the cord of the exemplified embodiment of the present invention.
Figure 12:
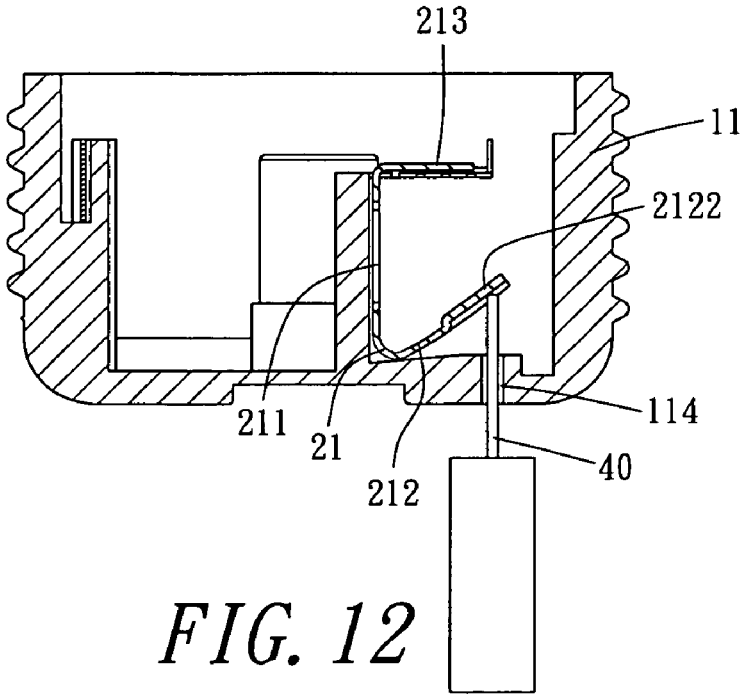
FIG. 12 is a sectional side view of the stripping for the cord of the exemplified embodiment of the present invention.
Figure 13:
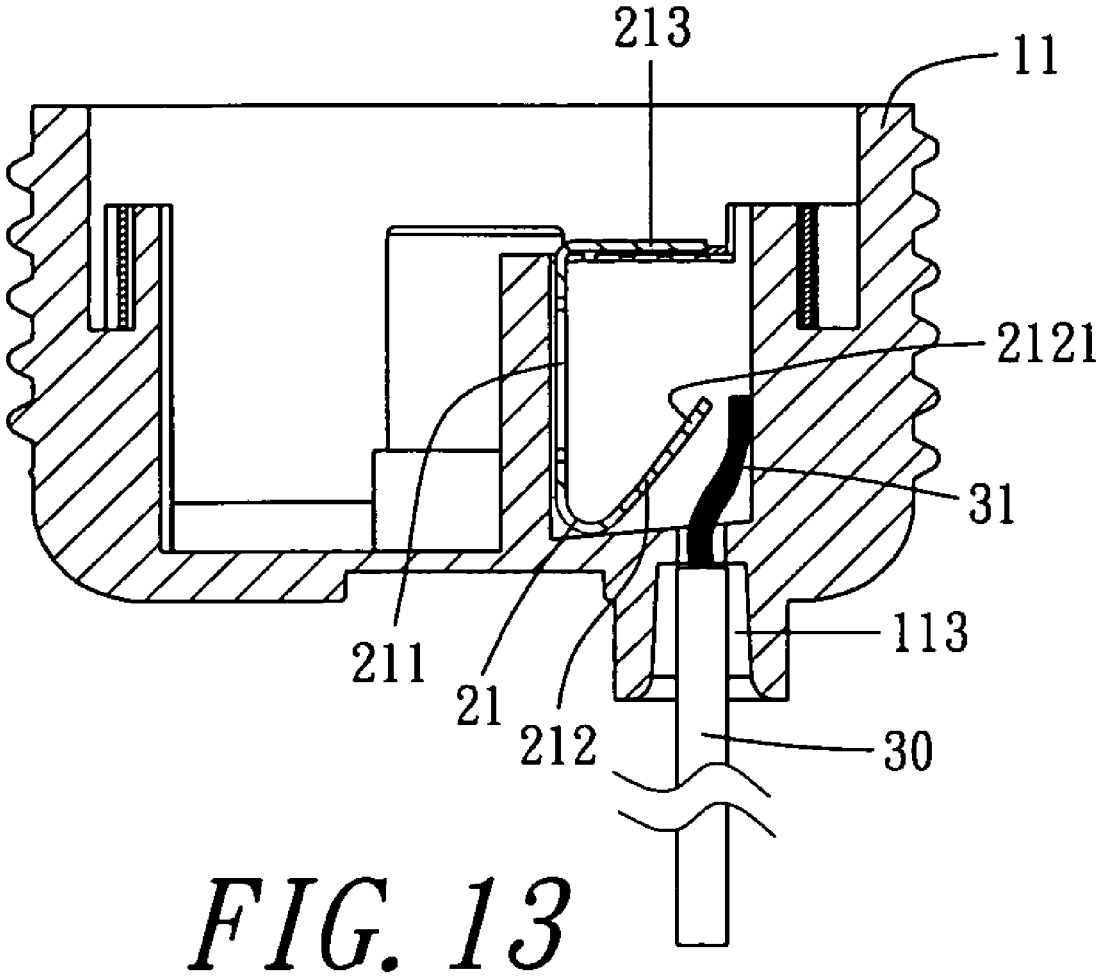
FIG. 13 is another sectional side view of the stripping for the cord of the exemplified embodiment of the present invention.

As for the stripping of the conducting end portion 31 of the power cord 30 from the contact with the power connect notch 2121, shown in FIGS. 11-13, it can be accomplished by inserting a slender stripping tool 40 into the cord-stripped socket 114 until a touch to the cord-stripped trench 2122. With a successive pressure to bend the cord-stripped trench 2122, the power connect notch 2121 is also bent due to the pressure, which the conducting end portion 31 is released from the clamping shown in FIG. 13, and that makes the conducting end portion 31 to withdraw from the push-cord hole 113, to achieve stripping the cord with ease.

To sum up, the disclosed push-cord energy saving lamp holder easy for stripping of cord of the present invention was not known to the public, and is absolutely novel; it surely can accomplish the expected inventive objective and function of usage, which is construed as creativeness and usefulness that is compliant to the requirements of a utility patent, and an application is then filed according to the patent law, which deserves your favorable examination and approval.

What is claimed is:

1. A push-cord energy saving lamp holder easy for the stripping of cord, comprises:

a lamp holder body, having a set of symmetrically positioned push-cord holes and nearby a set of cord-stripped sockets at its top, a hollow at its bottom, where the push-cord holes and the cord-stripped sockets all extend to the internal of said lamp holder body, and said lamp holder body being further provided with a set of symmetrically positioned first lodging troughs and second lodging troughs at its internal, which are formed by the gaps among the uneven erect pillars;

a set of push-cord stands, each having a plug face from which a power connect face and a conducting face are formed by bending its top and bottom portions, where the edge of the power connect face is divided into a power connect notch at the inner side and a cord-stripped trench at the outer side, while the conducting face is a flat piece, during the assembly, the plug face being lodged in the first lodging trough for a fixing, where the power connect notch of the power connect face is positioned right inside the push-cord hole, and the cord-stripped trench being positioned right inside the cord-stripped socket, the conducting end portion, made from the peeling of the skin of the end portion of a power cord, being inserted in the push-cord hole to connect to the power connect notch, by pressing the power connect notch, the conducting end portion being clamped in the gap between the power connect notch and said lamp holder body, and the electric power being thus conducted to said push-cord stand;

a set of conducting springy slices, having a plug face and a conducting face, where the plug face is lodged in the second lodging trough for a fixing during the assembly, and the back end of the conducting face being connected to the conducting face of said push-cord stand for the conduction of power;

a cover plate, having a set of symmetrically located positioning grooves on the plate which comprises a major opening and a connected thin arced groove, during the assembly, said cover plate being placed on the hollow of said lamp holder body, which makes said conducting springy slice to correspond to the positioning groove and residing next to the positioning groove, where the major openings of the positioning grooves accommodate the insertion of the two conducting terminals of an energy saving lamp, followed by a twist of the terminals along the thin arced grooves and a contact with said conducting springy slice for a fixing, and eventually the conduction of power from said conducting springy slice being to illuminate the energy saving lamp;

wherein the cord-stripped socket is being designed for accommodating the insertion of a slender cord-stripped tool, where the tool is pushed to bend the cord-stripped trench, which in turn bends the power connect notch, and the effect causing the conducting end portion of the power cord being released from the clamping, where the conducting end portion is thus easily stripped from the push-cord hole.

* * * * *